United States Patent [19]

Vogt

[11] Patent Number: 4,981,064

[45] Date of Patent: Jan. 1, 1991

[54] FINGERBOARD FOR PLUCKED AND STRINGED INSTRUMENTS

[76] Inventor: Walter J. Vogt, Pfarrer-Egen-Weg 11, 7420 Horb-Mühlen, Fed. Rep. of Germany

[21] Appl. No.: 444,662

[22] Filed: Dec. 1, 1989

[30] Foreign Application Priority Data

Dec. 8, 1988 [DE] Fed. Rep. of Germany ..... 3841291

[51] Int. Cl.[5] ..... G10D 3/06

[52] U.S. Cl. ..... 84/314 R

[58] Field of Search ..... 84/314 R, 293

[56] References Cited

U.S. PATENT DOCUMENTS 3,273,439 9/1966 Keefe et al. ..... 84/314 R
4,620,470 11/1986 Vogt ..... 84/314 R
4,723,469 2/1988 Vogt ..... 84/314 R

FOREIGN PATENT DOCUMENTS 355351 6/1922 Fed. Rep. of Germany .

*Primary Examiner*—Brian W. Brown
*Attorney, Agent, or Firm*—Shenier & O'Connor

[57] ABSTRACT

A fingerboard for plucked and stringed instruments comprises transversely extending frets for altering the pitch of strings which are tightened over the length of the fingerboard. The frets are divided up in the region in which the individual strings are tightened across them into fret elements which are adjustable in the longitudinal direction of the strings on the fingerboard. Structural sections in which the fret elements are individually displaceable over a large area are inserted in the fingerboard so as to extend continuously over substantially the entire length of the fingerboard and parallel to the strings. The fret elements are, furthermore, held by frictional connection in the structural sections in such a way that they are infinitely displaceable only by intentional, external force acting in the longitudinal direction of the structural sections.

16 Claims, 3 Drawing Sheets

FINGERBOARD FOR PLUCKED AND STRINGED INSTRUMENTS

The invention relates to a fingerboard for plucked and stringed instruments, in particular guitars, lutes and viole da gamba, with transversely extending frets for altering the pitch of strings which are tightened over the length of the fingerboard, the frets being divided up in the region in which the individual strings are tightened across them into fret elements, and these elements being adjustable in the longitudinal direction of the strings on the fingerboard, with structural sections which extend continuously over substantially the entire length of the fingerboard and parallel to the strings and in which the fret elements are individually displaceable being inserted in the fingerboard, and with the fret elements being held by frictional connection in the structural sections in such a way that they are infinitely displaceable only by intentional, external force acting in the longitudinal direction of the structural sections.

In a known fingerboard of this kind (German Patent No. 355 351) the fret elements are held in a frictionally connected manner in the structural sections by sidewardly acting screws which are each associated with several fret elements and so when the screws are released for adjustment of a certain fret element, there is the danger that several fret elements will, in an undesired manner, simultaneously move along with it. In connection with the prior art, reference should also be had to U.S. Pat. Nos. 4,620,470 and 4,723,469.

The object underlying the invention is to remedy this deficiency and to so improve a generic fingerboard that individual adjustment of the individual fret elements is possible without other fret elements being moved along with them.

The object is accomplished, in accordance with the invention, in that the structural sections have a C-shaped profile in cross-section and the fret elements are held in the structural sections by rubber members.

Further features of the invention are to be found in subclaims 2 through 16.

Figure 1:
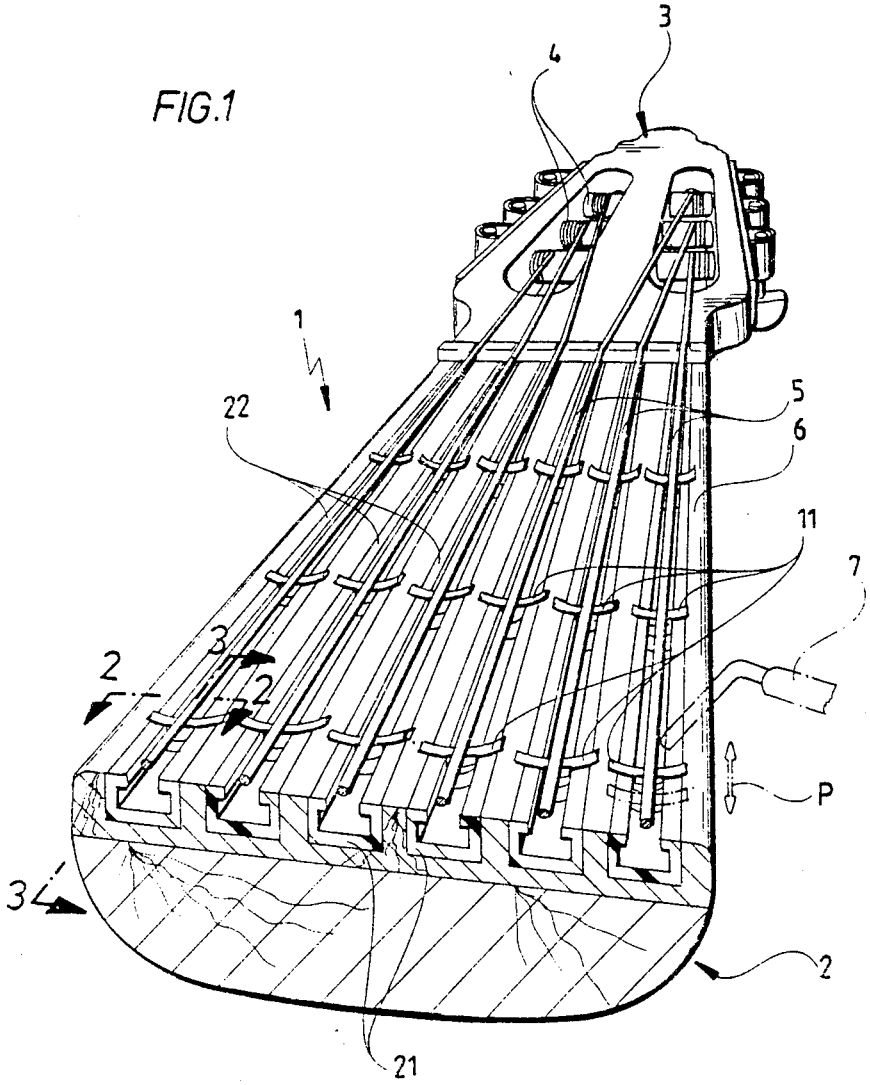
Figure 5:
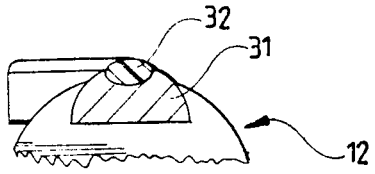
Figure 2:
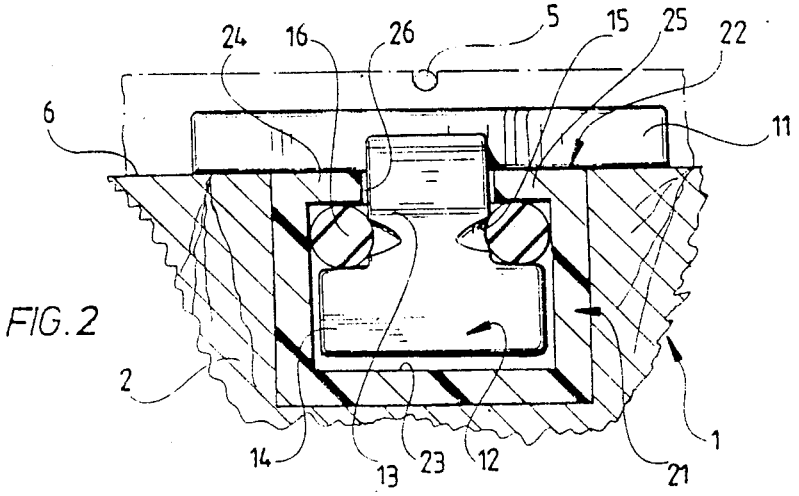
Figure 3:
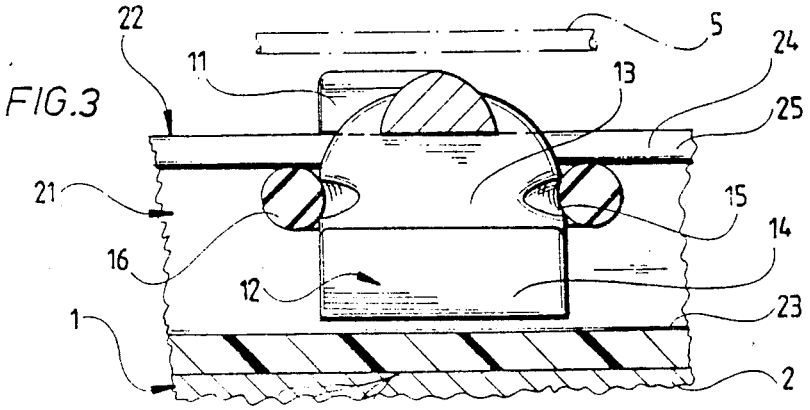
Figure 4:
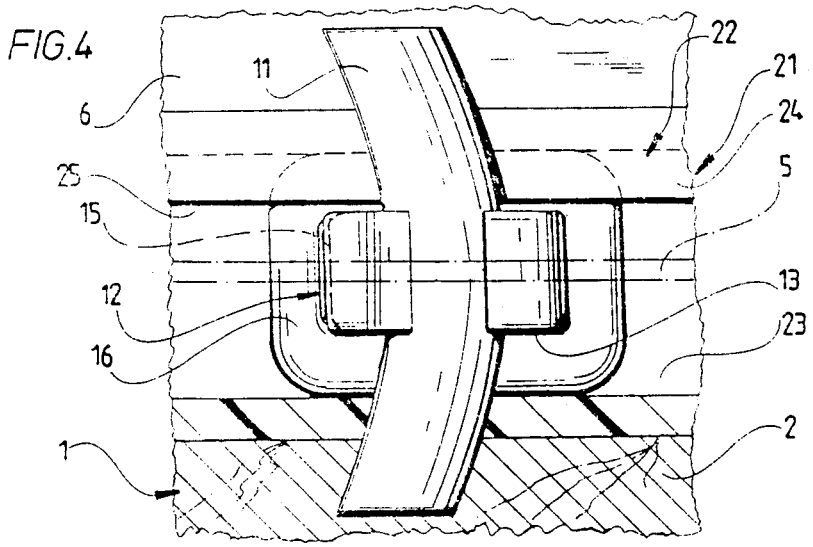
Figure 6:
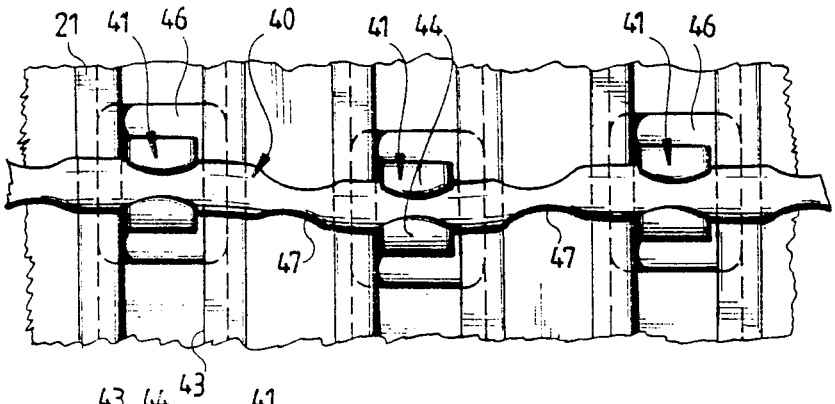
Figure 7:
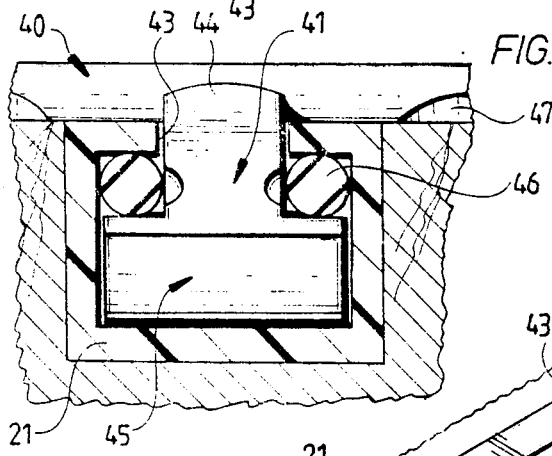
Figure 8:
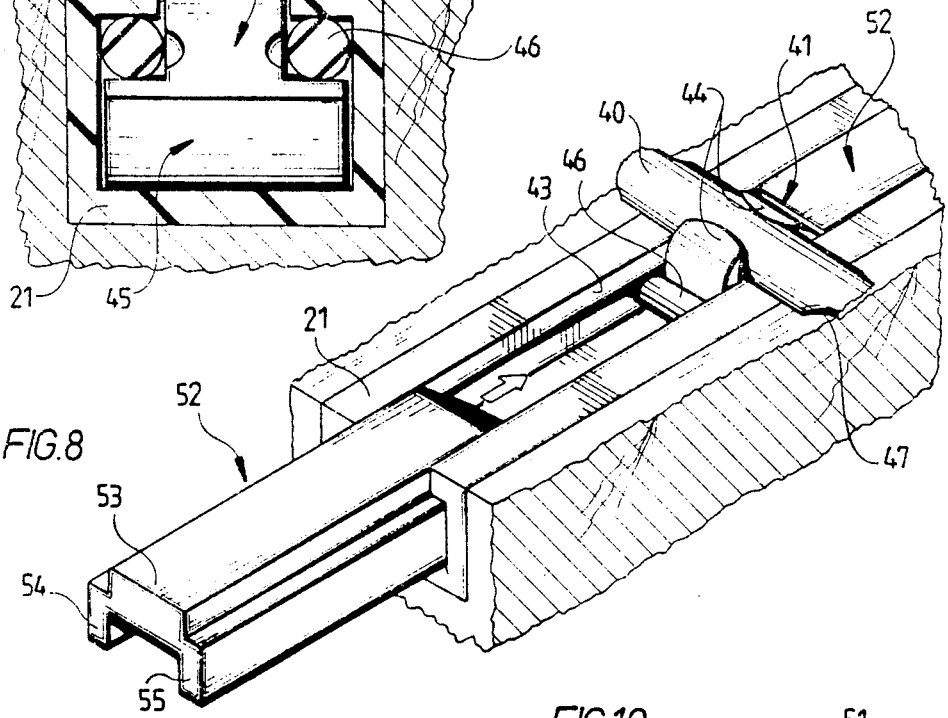
Figure 9:
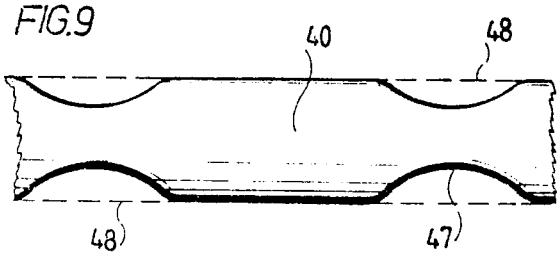

The following description of preferred embodiments serves in conjunction with the appended drawings to explain the invention in further detail. The drawings show:

FIG. 1 a sectional, perspective view of the neck of a guitar;

FIG. 2 a sectional view along line 2—2 in FIG. 1;

FIG. 3 a sectional view along line 3—3 in FIG. 1;

FIG. 4 a plan view of a fret element according to FIGS. 2 and 3;

FIG. 5 a partial view of a modified fret element with a nylon insert;

FIG. 6 another embodiment of fret elements with a foot according to the invention;

FIG. 7 a front view of the fret element with a foot from FIG. 6;

FIG. 8 a further modified embodiment of the invention;

FIG. 9 the fret element from FIG. 6; and

Figure 10:
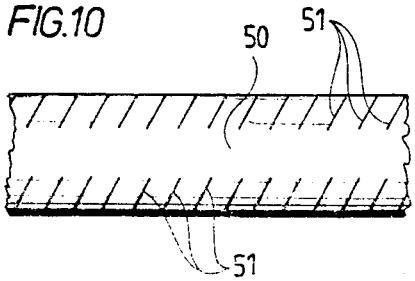

FIG. 10 a modification of FIG. 9.

FIG. 1 shows a fingerboard 1 made, for example, of black ebony and fixedly connected, in the conventional manner, to the neck 2 of a guitar. The neck 2 is connected, on the one hand, to a body, not illustrated, and, on the other hand, to a peg board 3 of the guitar. Mounted for rotation on the peg board 3 are pegs 4 which serve, in the usual manner, to tighten six strings 5 extending in the longitudinal direction of the fingerboard 1. Associated with each string 5 are fret elements 11 which are arranged in mutually spaced relation in the longitudinal direction of the fingerboard 1. The fret elements 11 extend transversely to the longitudinal direction of the strings 5 and determine in the known manner the pitch of a string 5 pressed against them. The individual fret elements 11 are, as depicted, of slightly arcuate configuration.

As best seen in FIGS. 2 through 4, the fret elements 11 are fixedly connected to a foot 12 which protrudes downwardly from them. The foot 12 comprises a shaft 13 which is attached to the fret element 11 and a transverse web 14 which protrudes from the shaft 13 in the form of an inverted "T" and extends substantially parallel to the fret element 11. A recess 15 extending around the shaft 13 serves to receive a ring-shaped, rubber member 16 which encircles the foot 12. The rubber member 16 is normally of annular configuration and when placed on the foot 12 is stretched under pretension so as to assume on account of the substantially rectangular cross-sectional shape of the shaft 13, the approximately rectangular shape apparent from FIG. 4.

Structural sections 21 extending continuously over substantially the entire length of the fingerboard 1 and parallel to the strings 5 are fixedly inserted, for example, adhesively, in the fingerboard 1 (cf. FIG. 1). Their top surfaces 22 lie flush with the surface 6 of the fingerboard 1 (FIG. 2). The sections have a C-shaped cross-sectional profile, with two flanges 24, 25 extending in spaced relation parallel to a bottom 23 of the section being located above this bottom 23 and a space 26 parallel to the string 5 extending symmetrically thereabove remaining free between the flanges 24, 25. The shaft 13 of the foot 12 connected to the fret element 11 extends through this space so the transverse web 14 of the foot 12 is located inside the structural section 21 and the fret element 11 lies on the outer side of this section. The two flanges 24, 25 of the structural section thereby overlap the transverse web 14 in the manner shown in FIG. 2 so the fret element cannot be pulled upwards out of the structural section and, therefore, cannot be removed from the fingerboard 1.

The structural sections 21 are open at one or both ends, preferably at the end facing the body of the guitar, so the fret elements can be inserted thereat with the transverse web 14 and moved to their designated place.

The rubber members 16 rest under elastic pretension, on the one hand, against the underside of the flanges 24, 25 and, on the other hand, on the top surface of the transverse web 14. The arrangement, i.e., the spacing between the members 16 and the underside of the fret element 11 is such that the members 16 which are elastically compressed to some extent when the fret elements 11 are inserted into the structural sections 21 endeavor to press the transverse web 14 downwards and hence bring the underside of the fret element 11 into abutment with the top surface 22 of the structural section 21. Since this top surface is flush with the surface of the fingerboard 1, the underside of the fret element 11 thereby also comes into direct contact with the fingerboard 1. By virtue of this pretension imparted by the rubber member 16, the fret element 11 is fixedly held by frictional connection on the fingerboard 1 while the guitar is being played. To tune the guitar, the fret element 11 is infinitely displaced by external force acting in the longitudinal direction of the section, cf. the dot-and-dash double arrow P and the displaced position of the fret element 11 next to the double arrow, similarly illustrated in dot-and-dash lines, in FIG. 1. The displacement can be carried out with the aid of a small hook-shaped tool 7, likewise indicated in dot-and-dash lines in FIG. 1, or with a fingertip or a fingernail.

If necessary, adjustment of the fret element 11 while moving it with the fingertip or fingernail is also possible while the guitar is being played. The ring-shaped rubber member 16 merely has to have the appropriate dimensions for establishing a frictional connection between the fret element 11 and the fingerboard 1 such that the fret element is fixed while the guitar is being played but, on the other hand, is displaceable by a relatively small external force. The fret elements can be individually displaced within a large area in the structural sections 21 extending continuously over the entire length of the fingerboard 1 so that any desired type of tuning is possible.

The structional sections 21 preferably consist of light metal, more particularly, an aluminum alloy. In the latter case, the surface of the structural section is advantageously age-hardened in order to increase the resistance to wear with respect to displacement of the fret elements 11 resting on the surface. The age-hardening can be carried out, for example, in a manner known per se, by applying a hard aluminum oxide layer. The outer coloring of the structural sections 21 corresponds at least in the region of the top surface 22 of the flanges 24, 25 to that of the top surface of the fingerboard 1, i.e., it is normally also black.

Since the underside of the fret element 11 is in direct contact with the surface 6 of the fingerboard 1 and with the top surface of the structural section 21, good sound transmission from the string 5 pressed against the fret element is ensured. It has, furthermore, been found that a musical instrument which has a hollow space formed by the interior of the structural section 21 and extending parallel beneath each string 5 in the above-described manner produces a better sound on account of certain resonance phenomena than conventional instruments which do not have such groove-like hollow spaces extending parallel to the strings. This improvement in sound is presumably due to the fact that a column of air of quite large cross-section in the region below the string can be incited to resonate along with it. The structural sections 21, therefore, serve not only to adjust the fret elements 11 but also to improve the sound of the instrument.

The adjustable fret elements 11 described above together with the structural sections ensuring their continuous displacement are not only suitable for guitars but also for other plucked instruments, for example, lutes, and for stringed instruments such as viole da gamba or the like.

An advantage of the inventive fingerboard is that more frets than hitherto can be variably arranged on the fingerboard so tuning for microtonal music or enharmonic tuning are also possible.

In keeping with the illustration in FIG. 3, FIG. 5 shows a modified fret element 31 wherein an insert 32 made of plastic material, preferably nylon, is placed in a corresponding groove on the top surface of the element 31. Such an insert reduces the wear of the strings 5 pressed against the fret element 31.

FIGS. 6, 7 and 8 relate to a fret element representing a modification of that of FIG. 5. While in FIG. 5 (likewise in FIGS. 1 through 4) the individual fret elements 31 each form with their plastic inserts 32 separate parts, in the embodiment according to FIGS. 6 through 8, the plastic insert 32 according to FIG. 5 of adjacent fret elements is modified to form a coherent, flexible fret element 40 which consists of a correspondingly flexible material, more particularly, plastic, preferably nylon. In the embodiment according to FIG. 5, the portion 31 carrying the plastic insert 32 protrudes on both sides far above the upwardly open longitudinal slot of the structural section 21. In contrast, in the embodiment according to FIGS. 6 through 7, a portion 41 carrying the coherent fret element 40 and corresponding to the portion 31 in FIG. 5 is so narrow that it does not rise above the upwardly open longitudinal slot 43 of the structural section 21 at the sides thereof. Each portion 41 comprises two clamping jaws 44 which rest against the fret element 40. The clamping jaws 44 releasably clamp and hold the coherent, flexible fret element 40 between them so the coherent, flexible fret element 40 extends continuously from portion 41 to portion 41 over the entire width of the fingerboard 1. The flexibility and yielding nature of the continuous fret element 40 enables individual displacement of the individual portions 41.

The continuous, coherent fret elements 40 have the advantage that the guitar strings 5 can be moved further to the side or "distorted" in comparison with the relatively short fret elements 11 (cf. FIG. 1), as is desired for certain ways of playing the guitar.

As illustrated, the clamping jaws 44 of each portion 41 are, in turn, provided with a foot 45 which is downwardly directed into the structural section 21. The foot 45 corresponds to the foot 12 of the embodiment according to FIGS. 1 through 5 and has essentially the shape of an inverted "T". A recess extending around the shaft of the foot 45 receives a ring-shaped, rubber member 46 which encircles the foot 45 in the region of the shaft of the foot 45. The rubber member 46 corresponds to the rubber member 16 of the embodiment according to FIGS. 1 through 5. The thickness or height of the part of the foot 45 extending below the rubber member 46 is of such dimensions that the rubber member 46 presses the underside of the foot 45 onto the bottom of the structural section. This ensures good transmission of sound. Insofar, the foot assumes the function of the element 11 protruding transversely at the sides in the embodiment according to FIGS. 1 through 5 in which it is pressed by the rubber member 16 against the top surface of the structural section 21, while the foot 12 hangs freely inside the structural section 21 (cf. FIG. 2).

Viewed from above, the clamping jaws 44 are of convexly curved configuration towards the fret elements 40, as shown in FIGS. 6 through 8.

In the embodiment shown in FIGS. 6 to 9, the coherent fret element 40 comprises within the spacing between two adjacent strings 5 recesses 47 which, on the one hand, increase the flexibility of the continuous fret element 40 between two portions 41 and, on the other hand, facilitate exchange of the fret elements 40. To exchange the fret element 40, it only has to be moved by the amount of the spacing between two strings 5 in the direction of its longitudinal axis because the recesses 47 then lie between the clamping jaws 44 and hence the fret element can be pulled out freely in the upward direction and released from the portions 41.

It is not absolutely necessary for the continuous fret elements 40 to have recesses 47. As indicated by the dashed line 48 in FIG. 9, the fret element 40 could also be of continuous circular cross-sectional shape.

FIG. 10 shows a modified, continuous fret element 50 which is of continuous circular cross-sectional shape. It has notches 51 at the sides in order to increase the flexibility of the fret element 50.

Finally, FIG. 8 shows a further modified embodiment of the invention. Numerous small blocks 52 are provided herein. Their outer contour corresponds to the inner contour of the structural sections 21 and their length is such that by insertion into the structural sections 21 they can be arranged with a certain amount of play between two respective portions 41 with the continuous fret elements 40 carried by these. The surfaces 53 of the small blocks 52 lie flush with the top surfaces of the structural sections 21. In this way, the finger of the guitar player which lies transversely across the fingerboard when a guitar string 5 is pulled to the side is not impeded by the upwardly open longitudinal slot 43 of the structural section 21.

The small blocks 52 are preferably made of a slightly elastic plastic material so that two downwardly directed legs 54, 55 of the small block 52 possess a certain inherent elasticity and cause wedging of the small blocks 52 in the structural sections 21.

It is possible for the fixing of the portions 41 in the structural sections 21 to be enhanced by appropriate wedging of the small blocks 52 in the structural sections 21. In this case, the small block can abut on the rubber member 46 of an adjacent portion 41 and additionally deform it in order to increase the clamping effect.

The present disclosure relates to the subject matter disclosed in German application No. P 38 41 291.8 of Dec. 8, 1988, the entire specification of which is incorporated herein by reference.

What is claimed is:

1. A fingerboard for a stringed instrument in which a plurality of elongated structural sections extending continuously over substantially the entire length of the fingerboard and parallel to the instrument strings receive fret elements which extend transversely of the fingerboard and over which the strings of the instrument are stretched with the fret elements held in said sections by frictional connection in such a way as to be infinitely displaceable only by intentional external force acting in the direction of the length of said structural sections wherein the improvement comprises that said structural sections (21) have a C-shaped profile in cross-section and said fret elements (11, 31) are held in said structural sections (21) by rubber members (16).

2. A fingerboard as in claim 1 wherein said structural sections (21) are formed of light metal.

3. A fingerboard as in claim 2 wherein said light metal is aluminum alloy.

4. A fingerboard as in claim 3 wherein said aluminum alloy has a surface, said surface being age-hardened.

5. A fingerboard as in claim 1 wherein said fingerboard (1) has grooves beneath the respective strings (5) of said instrument, said structural sections (21) being adhesively secured in respective ones of said grooves.

6. A fingerboard as in claim 1 wherein said fingerboard has a top surface and said sections have top surfaces which are flush with the fingerboard top surface.

7. A fingerboard as in claim 1 wherein each of said fret elements (11, 31) has a foot (12) with a web (14) which fits into one of said sections (21), said rubber members (16) being ring-shaped, said foot (12) being encircled by one of said rubber members (16).

8. A fingerboard as in claim 7 wherein said foot (12) has a groove (16) for receiving said ring-shaped member (16).

9. A fingerboard as in claim 7 wherein each of said fret elements (11,31) has an underside and each of said sections (21) has a top surface (22), each of said fret elements (11, 31) being held by a rubber member (16) in a structural section (21) in such a way that its underside is pressed directly against said top surface (22) of said section (21).

10. A fingerboard as in claim 1 wherein each of said fret elements (31) comprises a plastic insert (32).

11. A fingerboard as in claim 10 wherein the plastic inserts (32) of adjacent fret portions (41) form a coherent flexible fret element (40,50).

12. A fingerboard as in claim 11 wherein said fret elements (41) have feet (45) and said structural elements have bottoms, said rubber members (46) being provided on said feet (45) to press said feet (45) onto said bottoms.

13. A fingerboard as in claim 11 wherein said instrument strings (5) are spaced, said coherent fret element being provided with recesses (47) in the space between two adjacent strings (5).

14. A fingerboard as in claim 11 wherein said coherent fret elements (50) have sides formed with notches (51).

15. A fingerboard as in claim 11 wherein said fret elements (41) have feet (45) and clamping jaws (44), said coherent fret elements (40,50) being held at each foot (45) between said jaws (44), said clamping jaws viewed from above being convexly curved toward said fret elements.

16. A fingerboard as in claim 11 wherein said fret elements (41) have feet (45) and said sections (21) have upper surfaces, said improvement further comprising small blocks (52) slidable in said C-shaped structural sections (21) between the feet (45) of fret elements (41) which are associated with respective strings (5), said blocks (52) having upper surfaces (53) lying flush with the upper surfaces of said sections (21).

* * * * *